US009145860B2

(12) United States Patent
Usui et al.

(10) Patent No.: US 9,145,860 B2
(45) Date of Patent: Sep. 29, 2015

(54) HIGH-PRESSURE FUEL SUPPLY PUMP

(75) Inventors: Satoshi Usui, Hitachinaka (JP); Shigenori Tahara, Hitachinaka (JP); Kenichiro Tokuo, Hitachinaka (JP); Masashi Nemoto, Hitachinaka (JP); Akihiro Munakata, Hitachinaka (JP); Masayuki Suganami, Iwaki (JP); Tatsuo Kawano, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 686 days.

(21) Appl. No.: 13/578,380

(22) PCT Filed: Aug. 20, 2010

(86) PCT No.: PCT/JP2010/064046

§ 371 (c)(1), (2), (4) Date: Aug. 10, 2012

(87) PCT Pub. No.: WO2011/104907

PCT Pub. Date: Sep. 1, 2011

(65) Prior Publication Data

US 2012/0312278 A1 Dec. 13, 2012

(30) Foreign Application Priority Data

Feb. 26, 2010 (JP) ..... 2010-041245

(51) Int. Cl.
*F02M 55/02* (2006.01)
*F02M 59/46* (2006.01)
(Continued)

(52) U.S. Cl.
CPC ..... *F02M 59/462* (2013.01); *F02M 37/0041* (2013.01); *F02M 37/0052* (2013.01);
(Continued)

(58) Field of Classification Search
CPC ..... F02M 37/02; F02M 63/0225; F02M 63/0245; F02M 63/026; F02M 63/0265; F02M 63/0285; F02M 63/0295
USPC ..... 123/446, 447, 304, 467
See application file for complete search history.

(56) References Cited

U.S. PATENT DOCUMENTS 4,440,134 A * 4/1984 Nakao et al. ..... 123/447
6,021,761 A * 2/2000 Kellner et al. ..... 123/495
(Continued)

FOREIGN PATENT DOCUMENTS

JP 2006-132517 A 5/2006
JP 2008-002361 A 1/2008
(Continued)

OTHER PUBLICATIONS

Patent Office of the People's Republic of China; Notification of First Office Action on application 201080063579.6 mailed Jan. 6, 2014; pp. 1-3.
(Continued)

*Primary Examiner* — Thomas Moulis
(74) *Attorney, Agent, or Firm* — Foley & Lardner LLP

(57) ABSTRACT

A high-pressure fuel supply pump which has no probability of discontinuity of a thin film of fuel at a sliding portion even when the fuel is not needed to be compressed to a high pressure is obtained. Two low-pressure fuel ports are provided on the high-pressure fuel supply pump in addition to a high-pressure discharge port to a high-pressure fuel capacity chamber. One of the two low-pressure fuel ports is connected to a low-pressure fuel capacity chamber and remaining one is connected to a low-pressure fuel supply pump. Accordingly, the interior of the high-pressure fuel supply pump is always filled with fresh fuel even in a mode in which a high-pressure fuel injecting valve does not inject fuel and only a low-pressure fuel injection valve injects fuel, so that a temperature rise of a plunger and a cylinder is prevented and locking of the plunger and the cylinder can be prevented.

14 Claims, 11 Drawing Sheets

(51) Int. Cl.

| | |
|---|---|
| ***F02M 59/10*** | (2006.01) |
| ***F02M 59/36*** | (2006.01) |
| ***F02M 37/00*** | (2006.01) |
| ***F02M 55/04*** | (2006.01) |
| *F02M 63/02* | (2006.01) |
| *F02M 63/00* | (2006.01) |
| *F02M 69/04* | (2006.01) |

(52) U.S. Cl.
CPC ..... *F02M55/04* (2013.01); *F02M 59/102* (2013.01); *F02M 59/368* (2013.01); *F02M 63/029* (2013.01); *F02M 63/0001* (2013.01); *F02M 63/0265* (2013.01); *F02M 69/046* (2013.01); *F02M 2200/02* (2013.01)

(56) References Cited

U.S. PATENT DOCUMENTS

| | | | | |
|---|---|---|---|---|
| 6,196,191 | B1 * | 3/2001 | Rembold et al. | 123/447 |
| 7,121,261 | B2 * | 10/2006 | Kinose | 123/431 |
| 7,341,043 | B2 * | 3/2008 | Kurata et al. | 123/431 |
| 8,776,764 | B2 * | 7/2014 | Basmaji et al. | 123/495 |
| 8,973,556 | B2 * | 3/2015 | Hoefner et al. | 123/446 |
| 2005/0098155 | A1 * | 5/2005 | Yamazaki et al. | 123/431 |
| 2005/0268889 | A1 * | 12/2005 | Kojima et al. | 123/458 |
| 2006/0075992 | A1 * | 4/2006 | Akita et al. | 123/431 |
| 2007/0272204 | A1 * | 11/2007 | Gibson | 123/304 |
| 2009/0320796 | A1 | 12/2009 | Kojima et al. | |

FOREIGN PATENT DOCUMENTS

| | | | |
|---|---|---|---|
| JP | 2008-157094 | A | 7/2008 |
| JP | 2008-180169 | A | 8/2008 |
| JP | 2010-106741 | A | 5/2010 |

OTHER PUBLICATIONS

PCT International Search Report on application PCT/JP2010/064046 mailed Oct. 12, 2010; 2 pages.

* cited by examiner

HIGH-PRESSURE FUEL SUPPLY PUMP

TECHNICAL FIELD

The present invention relates to a high-pressure fuel supply pump suitable for being used in a fuel supply system of an internal combustion engine having both a high-pressure fuel injection valve configured to inject fuel directly into a cylinder (cylinder) and a low-pressure fuel injection valve configured to inject fuel to an air-intake port.

BACKGROUND ART

A fuel supply system of the related art described in JP-A-2008-157094 includes a low-pressure fuel supply system configured to supply fuel to a low-pressure fuel capacity chamber (also referred to as a common rail) provided with a low-pressure fuel injection vale through a low-pressure fuel channel by a feed pump (low-pressure fuel supply pump) configured to pump up fuel from a fuel tank and a high-pressure fuel supply system configured to pressurize the fuel pumped up by the feed pump by a high-pressure fuel supply pump and then supply the high-pressure fuel to a high-pressure fuel capacity chamber (also referred to as a high-pressure fuel accumulator) provided with a high-pressure fuel injection valve.

Specifically, the high-pressure fuel supply system includes a bifurcated piping provided at a midpoint of a low-pressure fuel supply piping of the low-pressure fuel supply system, and one piping of the bifurcated piping is connected to the high-pressure fuel pump and the other piping is connected to the low-pressure fuel capacity chamber.

CITATION LIST

Patent Document

PLT 1: JP-A-2008-157094

SUMMARY OF INVENTION

Technical Problem

In the configuration of the related art, in a port injection mode in which only a low-pressure fuel injection valve injects fuel, it is not necessary to discharge pressurized fuel from the high-pressure fuel supply pump, the fuel taken into a compression chamber of the high-pressure supply pump is returned to a low-pressure channel without being compressed. However, a plunger, which is a fuel compressing member of the high-pressure fuel supply pump, repeats a reciprocating motion in the high-pressure fuel supply pump. In this state, the fuel runs into a dead end in the compression chamber, and the fuel in the high-pressure fuel supply pump is not discharged to the high-pressure fuel capacity chamber.

Therefore, a function to discharge frictional heat generated by a sliding movement between the plunger and a cylinder by discharged fuel does not work, and hence the temperature of the high-pressure pump increases. Then, a liquid film of gasoline existing in a minute clearance (sliding clearance) between the cylinder and the plunger evaporates, so that the liquid film of gasoline cannot be secured sufficiently.

Consequently, there is fear that the cylinder and the plunger are burned out and is secured (locked), which may result in a problem of loss of the function to compress and discharge low-pressure fuel by the high-pressure fuel supply pump.

Means for Solving the Problems

In the invention, in order to solve the above-described problem, low-pressure fuel is configured to flow to a low-pressure fuel channel on the side of the low-pressure fuel supply system via a low-pressure fuel channel provided in a body of the high-pressure fuel supply pump even while the high-pressure fuel supply pump is making a pause.

Preferably, the fuel from the low-pressure fuel supply pump is introduced to a low-pressure fuel capacity chamber via a damper chamber of the high-pressure fuel supply pump.

Preferably, the fuel from the low-pressure fuel supply pump is introduced to a low-pressure fuel capacity chamber via a plunger seal chamber of the high-pressure fuel supply pump.

Also preferably, the fuel from the low-pressure fuel supply pump is introduced to a low-pressure fuel capacity chamber by flowing through a damper chamber and a plunger seal chamber of the high-pressure fuel supply pump in this order.

Alternatively, the fuel from the low-pressure fuel supply pump is introduced to a low-pressure capacity chamber via a plunger seal chamber and a damper chamber of the high-pressure fuel supply in this order.

Specifically, the high-pressure fuel supply pump includes two low-pressure fuel inlet and outlet ports in addition to a high-pressure fuel discharge port configured to discharge high-pressure fuel to a high-pressure fuel capacity chamber, one of the two low-pressure fuel inlet and outlet ports is connected to a low-pressure fuel piping continued to a low-pressure fuel capacity chamber and remaining one communicates with the low-pressure fuel piping connected to the low-pressure fuel supply pump (feed pump).

Preferably, one of the low-pressure fuel inlet and outlet ports is fixed to the damper cover, and the corresponding one of low-pressure fuel inlet and outlet ports communicates with the damper chamber.

Preferably, one of the low-pressure fuel inlet and outlet ports is fixed to a pump body and the corresponding one of the low-pressure fuel inlet and outlet ports is connected to the plunger seal chamber of the high-pressure fuel supply pump (FIG. 4, FIG. 6, FIG. 9, FIG. 12).

Preferably, the low-pressure fuel inlet and outlet port connected to the low-pressure fuel supply pump is fixed to a pump body, and the low-pressure fuel inlet and outlet port is connected to a plunger seal chamber of the high-pressure fuel supply pump, and the other low-pressure fuel inlet and outlet port connected to the low-pressure fuel capacity chamber is fixed to a damper cover, and the other low-pressure fuel inlet and outlet port communicates with a damper chamber.

Preferably, the low-pressure fuel inlet and outlet port connected to the low-pressure fuel supply pump is fixed to the damper cover, and the other low-pressure fuel inlet and outlet port communicates with a damper chamber and the other low-pressure fuel inlet and outlet connected to the low-pressure fuel capacity chamber is connected to a plunger seal chamber of the high-pressure fuel supply pump.

Preferably, the fuel flows into a damper chamber from the low-pressure fuel inlet and outlet port fixed to a damper cover of the high-pressure fuel supply pump, and flows from the damper chamber to an intake port and a plunger seal chamber of the high-pressure fuel supply pump, and is introduced to the low-pressure fuel capacity chamber from another low-pressure fuel inlet and outlet port fixed to a pump body of the high-pressure fuel supply pump via the plunge seal chamber.

Preferably, the fuel flows into a plunger seal chamber of the high-pressure fuel supply pump from the low-pressure fuel inlet and outlet port fixed to a pump body of the high-pressure fuel supply pump, and flows from the plunger seal chamber to a damper chamber and an intake port of the high-pressure fuel supply pump, and is introduced to the low-pressure fuel capacity chamber from another low-pressure fuel inlet and outlet port fixed to a dumper cover of the high-pressure fuel supply pump.

Preferably, the fuel flows into an intake port and a damper chamber of the high-pressure fuel supply pump from the low-pressure fuel inlet and outlet port fixed to a pump body of the high-pressure fuel supply pump, and introduced from another low-pressure fuel inlet and outlet port fixed to a damper cover of the high-pressure fuel supply pump to the low-pressure fuel capacity chamber and the plunger seal chamber and an intake port communicate with each other.

Preferably, the fuel flows into an intake port and a damper chamber of the high-pressure fuel supply pump from the low-pressure fuel inlet and outlet port fixed to a pump body of the high-pressure fuel supply pump, and introduced from another low-pressure fuel inlet and outlet port fixed to a damper cover of the high-pressure fuel supply pump to the low-pressure fuel capacity chamber, the plunger seal chamber and an intake port communicate with each other, and the low-pressure fuel capacity chamber and an exit piping of the low-pressure fuel supply pump are connected to each other.

Advantages of the Invention

According to the invention configured as described above, since fresh fuel is supplied to the low-pressure fuel channel portion even when the high-pressure fuel supply pump does not discharge the fuel, a temperature rise of the plunger and the cylinder can be prevented and, consequently, the temperature rise of the fuel in the high-pressure fuel supply pump can be inhibited. Accordingly, fuel depletion on a sliding surface of the plunger and the cylinder is inhibited so that locking between the plunger and the cylinder can be prevented.

Other objects, characteristics, and advantages of the invention may be apparent from the description of embodiments of the invention described below with reference to attached drawings.

DESCRIPTION OF EMBODIMENTS

Figure 1:
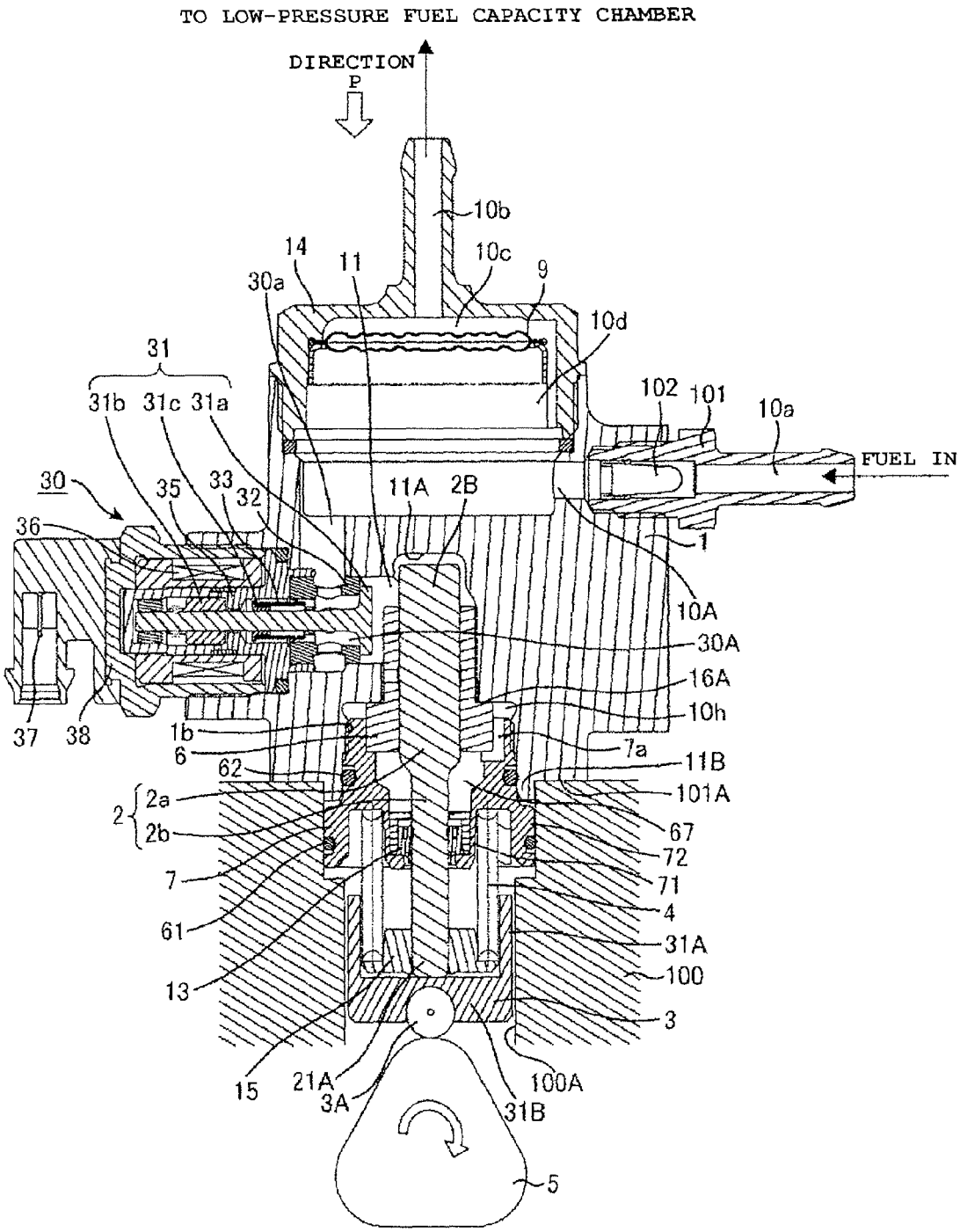
FIG. 1 is a vertical cross-sectional view of a high-pressure fuel supply pump according to a first embodiment in which the invention is implemented, taken along the line I-I in FIG. 8.
Figure 2:
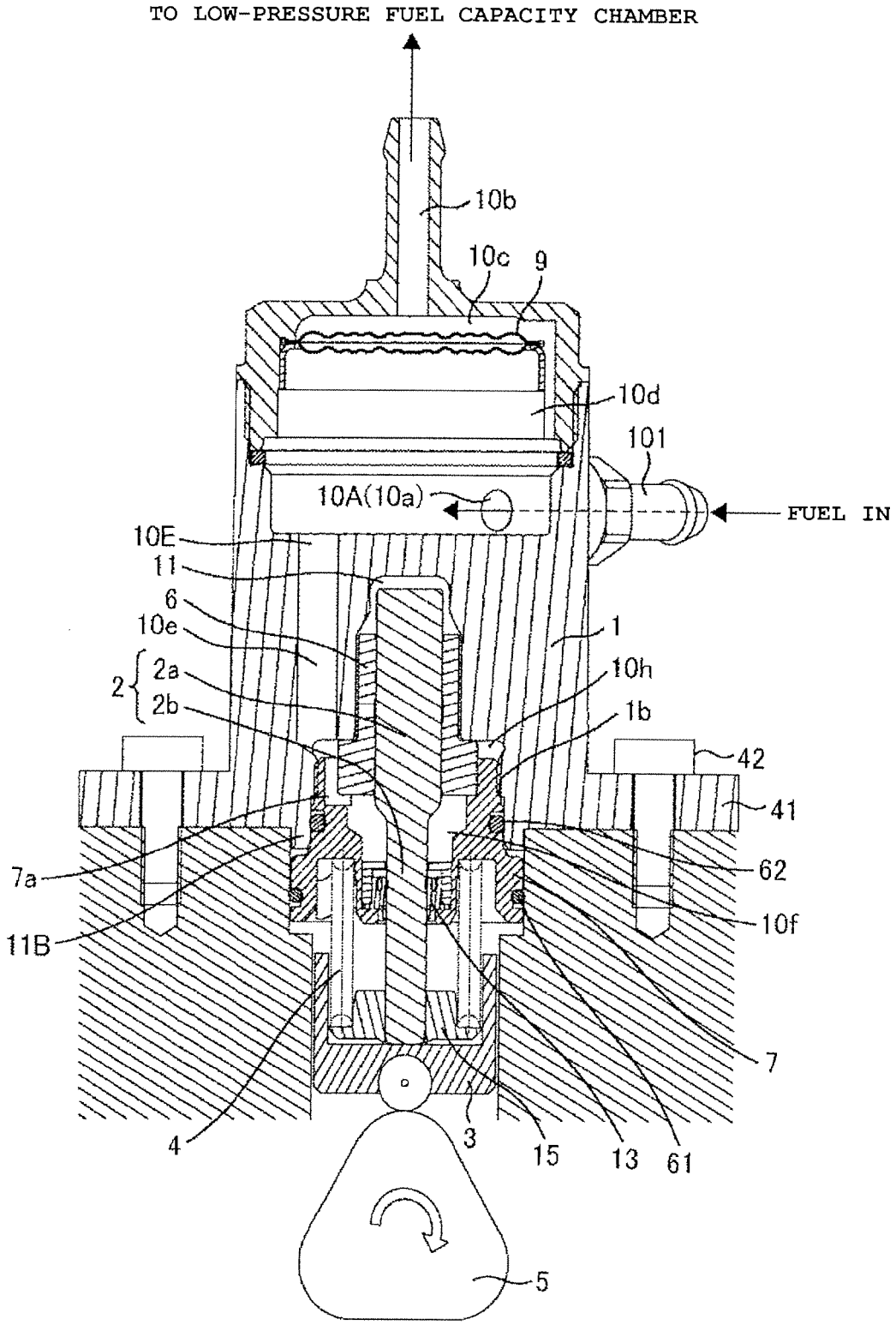
FIG. 2 is another vertical cross-sectional view of the high-pressure fuel supply pump according to the first embodiment in which the invention is implemented, taken along the line II-II in FIG. 8.

The invention will be described in detail on the basis of the embodiment shown in the drawings below.

Embodiment 1

A first embodiment will be described on the basis of FIG. 1 to FIG. 5 and FIG. 8.

A pump housing 1 is provided with a cup-shaped depression 11A for forming a compression chamber 11. A cylinder 6 is fitted into an opening of the depression 11A (compression chamber 11). An end portion of the cylinder 6 is pressed against a shouldered portion 16A provided at an opening of the compression chamber 11 of the pump housing 1 by a holder 7 by screwing the holder 7 at a screw portion 1*b*.

The cylinder 7 and the pump housing 1 are brought into press contact with at the shouldered portion 16A, and a fuel seal portion on the basis of metal contact is formed. The cylinder 6 is provided with a through hole (also referred to as a sliding hole) of a plunger 2 at the center thereof. The plunger 2 is loosely fitted into a through hole of the cylinder 6 so as to allow a reciprocal movement. A seal ring 62 is fitted on the outer periphery of the holder 7 at a position on the side opposite from the compression chamber 11 with respect to the screw portion 1*b*. The seal ring 62 forms a seal portion between the outer periphery of the holder 7 and an inner peripheral wall of the depression 11A of the pump housing 1 so as to prevent fuel from leaking.

A double cylindrical portion including an inner cylindrical portion 71 and an outer cylindrical portion 72 is formed on side opposite from the holder 7 with respect to the cylinder 6. A plunger seal apparatus 13 is held in the inner cylindrical portion 71 of the holder 7, and the plunger seal apparatus 13 is formed with a fuel trap portion 67 between an inner periphery of the holder 7 and a peripheral surface of the plunger 2. The fuel trap portion 67 traps fuel leaking from the sliding surface between the plunger 2 and the cylinder 6.

The plunger seal apparatus 13 prevents lubricating oil from entering into the fuel trap portion 67 from the side of a cam 5, described later.

The outer cylindrical portion 72 formed on the side opposite from the cylinder 6 of the holder 7 is inserted into a mounting hole 100A formed on an engine block 100. A seal ring 61 is mounted on an outer periphery of the outer cylindrical portion 72 of the holder 7. The seal ring 61 prevents the lubricating oil from leaking from the mounting hole 100A into the atmosphere, and prevents water from entering from the atmosphere.

The holder 7 is configured to have a larger diameter at the portion of the seal ring 61 than at the portion of the seal ring 62. This is effective to reduce head knocking of the pump body by increasing the surface area where the pump housing 1 is mounted on the engine block.

A lower end surface 101A of the pump housing 1 is in abutment with a mounting surface around the mouthing hole 100A of the engine block. The lower end surface 101A of the pump housing 1 is formed with an annular projection 11B at a center thereof.

The annular projection 11B is loosely fitted into the mounting hole 100A of the engine block 100, and has an outer diameter substantially the same as the outer diameter of the outer cylindrical portion 72 of the holder 7, and the head knocking of the pump body is devised to be received by the annular projection 11A and the lower end surface 101A.

The plunger 2 is formed to have a smaller diameter at a small diameter portion 2*b* extending from the cylinder toward the side opposite from the compression chamber than at a large-diameter portion 2*a* smoothly fitting to the cylinder 6. Consequently, the outer diameter of the plunger seal apparatus 13 is set to be smaller, by which a space for forming double cylindrical portions 71, 72 is secured on the holder 7 is secured. A spring receiver 15 is fixed to a distal end portion of the small diameter portion 2*b* of the plunger 2 where the diameter is reduced. A spring 4 is provided between the holder 7 and the spring receiver 15. An end of the spring 4 is mounted inside the outer cylindrical portion 72 around the inner cylindrical portion 71 of the holder 7. The other end of the spring 4 is arranged inside the retainer 15 formed of a metal having a bottomed cylinder. A cylindrical portion 31A of the retainer 15 is loosely fitted into the inner peripheral portion of the mounting hole 100A.

A lower end portion 21A of the plunger 2 is in abutment with the inner surface of a bottom portion 31B of a tappet 3. A rotating roller 3A is mounted on a center portion of the bottom portion 31B of the tappet 3. The roller 3A is pressed against the surface of the cam 5 by receiving a force of the spring 4. When the cam 5 rotates as a result, the tappet 3 and the plunger 2 reciprocate upward and downward along the profile of the cam 5. When the plunger 2 reciprocates, a pressure chamber side end portion 2B of the plunger 2 moves in and out from the compression chamber 11. When the pressure chamber side end portion 2B of the plunger 2 enters the compression chamber 11, fuel in the compression chamber 11 is pressurized to a high pressure, and is discharged to a high-pressure channel. Also, when the pressure chamber side end portion 2B of the plunger 2 retracts from the compression chamber 11, fuel is taken into the compression chamber 11 through an intake channel 30*a*. The cam 5 is rotated by a crankshaft or an overhead camshaft of an engine.

When the cam 5 is a three-lobe cam (having three lobes) shown in FIG. 1, when the crankshaft or the overhead camshaft rotates one turn, the plunger 2 reciprocates three times. In the case of a four-cycle engine, since the crankshaft rotates two turns in one burning step, when the cam 5 is rotated with the crankshaft, the cam reciprocates six times during one burning cycle (basically, the fuel injection valve injects fuel once to the cylinder), and compresses and discharges the fuel six times.

A joint 101 fixed to the pump housing 1 with screw or welding forms a low-pressure fuel port 10*a*. Inside the joint 101, a filter 102 is mounted. A damper cover 14 is fixed to a head portion of the pump housing 1, and a pressure pulsation reducing mechanisms 9 for reducing fuel pressure pulsation is stored in low-pressure chambers 10*c*, 10*d* formed between the damper cover 14 and the pump housing 1 in compartments.

A joint as a low-pressure fuel port 10*b* is formed on the head portion of the damper cover 14. The low-pressure chambers 10*c*, 10*d* are provided on both the upper and lower surfaces of the pressure pulsation reducing mechanism 9, respectively.

The damper cover 14 has a function to form the low-pressure chambers 10*c*, 10*d* for storing the pressure pulsation reducing mechanism 9 and a function to allow the fuel to flow to a low-pressure fuel capacity chamber 43 as a fuel trap of the low-pressure fuel injection valve via a joint as the low-pressure fuel port 10*b*.

Figure 5:
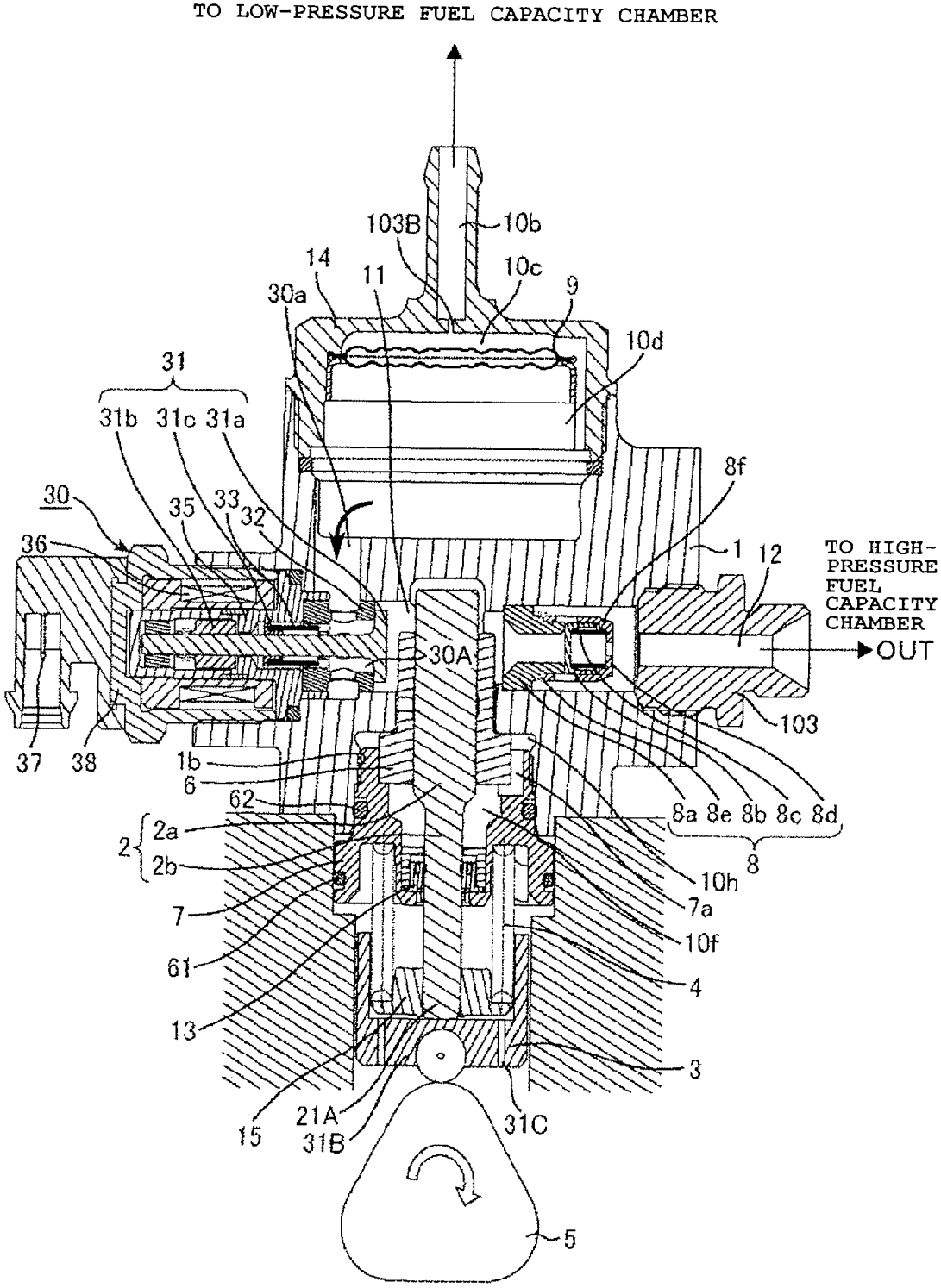
FIG. 5 is a vertical cross-sectional view of the high-pressure fuel supply pump according to the first embodiment in which the invention is implemented, taken along the line V-V in FIG. 8.

A discharge port 12 shown in FIG. 5 is defined by a joint 103 fixed to the pump housing 1 by a screw or welding.

The high-pressure fuel supply pump in the first embodiment is formed with two fuel channels including (route 1) a fuel channel routed from the low-pressure fuel port 10*a* of the joint 101—the low-pressure chamber 10*d*—the intake channel 30*a*—the compression chamber 11 to the discharge port 12 and (route 2) a fuel channel routed from the low-pressure fuel port 10*a* of the joint 101—the low-pressure chamber 10*d*—the low-pressure chamber 10*c* to the low-pressure fuel port 10*b*. For reference, (route 3) the low-pressure chamber 10*d*—a low-pressure fuel channel 10*e*—an annular low-pressure chamber 10*h*—a groove 7*a* formed on the holder 7—the fuel trap portion 67 (annular low-pressure chamber 10*f*) is also communicated. Consequently, when the plunger 2 reciprocates, the capacity of the fuel trap portion 67 (the annular low-pressure chamber 10*f*) increases and decreases, and the fuel comes and goes between the low-pressure chamber 10*d* and the fuel trap portion 67 (the annular low-pressure chamber 10*f*). Accordingly, heat of the fuel in the fuel trap portion 67 (the annular low-pressure chamber 10*f*) heated by sliding heat generated by the plunger and 2 and the cylinder 6 is exchanged with respect to the fuel in the low-pressure chamber 10*d* and hence is cooled.

A variable capacity control mechanism 30 is provided in the intake channel 30*a* at an entrance of the compression chamber 11. An intake valve member 31 is provided in the interior of the variable capacity control mechanism 30. The intake valve is urged in the direction closing an intake port 30A by a spring 33. Accordingly, the variable capacity control mechanism 30 is a check valve which allows fuel to flow only from the intake channel 30*a* toward the compression chamber 11 in a state in which no electricity is supplied.

A discharge valve unit 8 is provided at an exit of the compression chamber 11 (see FIG. 5). The discharge valve unit 8 includes a discharge valve sheet 8*a*, a discharge valve 8*b* moving toward and away from the discharge valve sheet 8*a*, a discharge valve spring 8*c* configured to urge the discharge valve 8*b* toward the discharge valve sheet 8*a*, and a discharge valve holder 8*d* configured to accommodate the discharge valve 8*b* and the discharge valve sheet 8*a*, and the discharge valve sheet 8*a* and the discharge valve holder 8*d* are joined at an abutting portion by a welding 8*e* to form an integral unit.

For reference, a shouldered portion 8*f* which forms a stopper for restricting the stroke of the discharge valve 8*b* is provided in the interior of the discharge valve holder 8*d*.

In a state in which there is no fuel pressure difference between the compression chamber 11 and the discharge port 12, the discharge valve 8*b* is in press-contact with the discharge valve sheet 8*a* by an urging force by the discharge valve spring 8*c* and is in a valve-close state. Only when the fuel pressure in the compression chamber 11 is increased to a level higher than the fuel pressure at the discharge port 12, the discharge valve 8*b* opens against the discharge valve spring 8*c*, and the fuel in the compression chamber 11 is discharged at a high pressure to the common rail as a low-pressure capacity chamber 23 through the discharge port 12. When the discharge valve 8*b* is opened, the discharge valve 8*b* comes into contact with a discharge valve stopper 8*f*, and is restricted from further stroke. Therefore, the stroke of the discharge valve 8*b* is determined adequately by the discharge valve stopper 8*d*. Accordingly, the discharge valve 8*b* is prevented from making too large stroke and closing in retard, and hence preventing fuel discharged to the discharge port 12 at a high pressure from flowing reversely into the compression chamber 11 again, so that the lowering of the efficiency of the high-pressure pump is restrained. Also, the discharge valve 8*b* is introduced by an inner peripheral surface of the discharge valve discharge valve holder 8*d* so as to move only in the stroke direction when the discharge valve 8*b* repeats valve opening and closing movements. In this configuration, the discharge valve unit 8 serves as a check valve for restricting the direction of flow of the fuel.

The cylinder 6 is held along the outer periphery thereof by the holder 7, and is fixed to the pump housing 1 at the screw portion 1*b* by screwing a thread formed on the outer periphery of the holder 7 into a thread formed on a pump body. The plunger 2 includes the large-diameter portion 2*a* and the small diameter portion 2*b*. The cylinder 6 holds the plunger 2 as a pressurizing member so as to be slidable upward and downward at the large-diameter portion 2*a*. The retainer 15 configured to convert the rotary motion of the cam 5 into the upward and downward movement, and transmit the same to the plunger 2 is fixed to the plunger 2 by press-fitting at a lower end of the plunger 2, and the plunger 2 is pressed against the bottom inner surface of the tappet 3 by the spring 4 via the retainer 15. Accordingly, in association with the rotary motion of the cam 5, the plunger 2 can be moved upward and downward. Also, the small diameter portion 2*b* of the plunger 2 is sealed by the plunger seal apparatus 13 on the lower side of the cylinder 6 in the drawing, and prevents gasoline (fuel) from leaking into the interior of the internal combustion engine from the high-pressure fuel supply pump. Simultaneously, lubricating oil (may be engine oil) of lubricating the sliding portion of the internal combustion engine is prevented from flowing into the interior of the pump housing 1.

In this configuration, the compression chamber 11 includes the variable capacity control mechanism 30, the discharge valve unit 8, the plunger 2, the cylinder 6, and the pump housing 1.

The fuel is introduced to the low-pressure fuel port 10*a* of the pump through an intake piping 28 in a low-pressure fuel supply pump 21 from a fuel tank 20. The low-pressure fuel supply pump 21 regulates the pressure of the incoming fuel to the pump housing 1 to a constant pressure by a signal from an engine control unit 27 (hereinafter, referred to as ECU). The fuel introduced to the low-pressure fuel port 10*a* of the pump housing 1 of the high-pressure fuel supply pump is supplied to the low-pressure fuel capacity chamber 43 through the route 2 described above.

Also, the high-pressure fuel compressed in the compression chamber is supplied to the high-pressure fuel capacity chamber 23 from the discharge port 12 via the route 1. High-pressure fuel injection valves 24 and a pressure sensor 26 are mounted on a high-pressure fuel capacity chamber 23. The number of the high-pressure fuel injection valves 24 mounted thereon corresponds to the number of cylinders of the internal combustion engine, and is configured to inject fuel to the combustion chamber of the internal combustion engine on the basis of the signal from the ECU 27.

The low-pressure fuel passed through the pump housing 1 is supplied to a low-pressure fuel capacity chamber 43 from the low-pressure fuel port 10*b* via a low-pressure piping 41. Low-pressure fuel injection valves 44 are mounted on the low-pressure fuel capacity chamber 43. The number of the low-pressure fuel injection valves 44 corresponds to the number of cylinders of the internal combustion engine and the fuel is injected to the air-intake port of the internal combustion engine on the basis of the signal from the ECU 27.

Subsequently, the variable capacity control mechanism 30 configured to regulate the amount of fuel discharged at a high pressure will be described using FIG. 1, FIG. 4 and FIG. 5.

The intake valve member 31 includes an intake valve 31*a*, an anchor 31*b*, and a spring stopper 31*c*, and the anchor 31*b* and the spring stopper 31*c* are pressed fitted into the intake valve 31*a* and fixed. The intake valve member 31 comes into contact with a seat 32 when the valve is opened, and the low-pressure chamber 10*d* and the compression chamber 11 are blocked. The intake valve spring 33 determines the urging force at a position where the spring stopper 31*c* is press fitted. When no electricity is distributed to a coil 36 of an electromagnetic driving mechanism and the fluid pressure difference between the intake channel 30*a* (the low-pressure chamber 10*d*) and the compression chamber 11 is zero, the intake valve member 31 is urged by the urging force of the intake valve spring 33 in the valve closing direction on the left side in the drawing as shown in FIG. 1.

When the plunger 2 is at an intake step (during the movement from an upper dead center position to a lower dead center position) by the rotation of the cam 5, the capacity of the compression chamber 11 is increased and the fuel pressure in the compression chamber 11 is lowered. When the fuel pressure in the compression chamber 11 is lowered to a level below the pressure in the low-pressure chamber 10*d*, a valve opening force caused by the fluid pressure difference of the fuel is generated in the intake valve member 31. The intake valve member 31 is set in such a manner that when the valve opening force by the fluid pressure difference exceeds the urging force of the intake valve spring 33, the intake valve member 31 overcomes the urging force of the intake valve spring 33 and is opened. Since the amount of displacement of the intake valve member 31 in the valve opening direction is restricted by a core 35, the anchor 31*b* and the core 35 are in contact with each other when opened completely. In this manner, the stroke of the intake valve member 31 is determined by the core 35.

When an input voltage from the ECU 27 is applied to the coil 36 via a terminal 37 in this state, an electric current flows through the coil 36. The waveform of the flowing current is determined by the value of resistance and the value of inductance of the coil 36. By means of this electric current, a magnetic urging force which attracts each other is generated between the anchor 31*b* and the core 35. However, the intake valve member 31 is completely opened due to the fluid pressure difference already, and is in contact with the core 35 or is opened halfway. Therefore, even when the magnetic urging force is generated at this time point, the anchor 31*b* and the core 35 are prevented from a significant collision. In this manner, a hitting sound of the intake valve at the time of valve opening is restricted. Also, the power for driving the intake valve may be reduced, and activation current may be eliminated or reduced.

The plunger 2 ends the air-intake step while maintaining the state of application of the input voltage to the coil 36, and goes to the compressing step (during the movement from the bottom dead center to the top dead center). When the plunger 2 is moved to the compressing step, since the valve-opening force caused by the fluid pressure difference is not generated but the state of application of the input voltage is maintained. Therefore, the magnetic urging force is still applied, and the intake valve member 31 is still opened. Therefore, in this state, since the fluid in the compression chamber 11 is returned to the intake channel 30*a* (the low-pressure chamber 10*d*) through the intake valve member 31 in the valve-opened state again eve when the capacity of the compression chamber 11 ire reduced in association with the compressing movement of the plunger 2, the pressure in the compression chamber is not increased. This step is referred to as a returning step (also referred to as spilling step). At this time, the urging force generated by the intake valve spring 33 and a valve closing force caused by the fluid force generated when the fuel flows reversely from the compression chamber 11 to the low-pressure chamber 10*d* act in the intake valve member 31. Since the valve closing force and the urging force of the intake valve spring 33 in the valve-closing direction are added and act against the magnetic urging force for maintaining the valve-opening state, the magnetic urging force needs to be parallel thereto. In this embodiment, as described above, since the force of the intake valve spring 33 is set to be very small so as to allow the intake valve member 31 to be opened completely or halfway due to the fluid pressure difference, the urging force in the valve opening direction is small. Consequently, the valve opening state can be maintained even with a small magnetic urging force.

In this state, when the input voltage from the ECU 27 is released, the electric current flowing in the coil 36 becomes zero. However, the magnetic urging force acting on the intake valve member is eliminated after a certain period of time (after the magnetic delay) from the state in which the input voltage is released (hereinafter, referred to as "magnetic release delay"). If the magnetic urging force is reduced and the total sum of the urging force generated by the intake valve spring 33 acting on the intake valve member 31 and the valve-closing force generated when the fuel flows reversely from the compression chamber 11 to the intake channel 30*a* (the low-pressure chamber 10*d*) is increased, the intake valve member 31 is shift to valve-closing. The fuel pressure in the compression chamber 11 is increased from this moment together with the upward movement of the plunger 2. Then, when a pressure equal to or higher than the pressure at the discharge port 12 is reached, a high-pressure discharge of fuel remaining in the compression chamber 11 is performed via the discharge valve unit 8, and the compressed fuel is supplied to the high-pressure fuel capacity chamber 23. This step is referred to as a discharging step. In other words, the compressing step by the plunger 2 includes the returning step and the discharging step.

Then, by controlling the timing of releasing the input voltage to the coil 36 (the valve-closing timing), the amount of high-pressure fuel to be discharged may be controlled. When the timing of releasing the input voltage (the valve-closing timing) is put ahead, the ratio of the returning step is small and the ratio of the discharging step is large in the compressing step. In other words, the amount of fuel returning to the intake channel 30*a* (the low-pressure chamber 10*d*) is small, and the fuel to be discharged at a high pressure is increased. In contrast, when the timing to release the input voltage is put behind, the ratio of the returning step is large and the ratio of the discharging step is small in the compressing step. In other words, the amount of fuel returning to the intake channel 30*a* (the low-pressure chamber 10*d*) is large, and the fuel to be discharged at a high pressure is reduced. The timing of releasing the input voltage depends on the instruction from the ECU.

In this configuration, a sufficient magnetic urging force for maintaining the intake valve member 31 in the valve-opening state is secured and, simultaneously, by controlling the timing for releasing the input voltage, the amount of fuel discharged at a high pressure can be controlled to an amount required by the internal combustion engine.

Since the fuel goes in and out always from the intake channel 30*a* (the low-pressure chamber 10*d*) during the three steps of the intake step, the returning step, and the discharging step described above, periodic pulsation is generated in the fuel pressure. The pressure pulsation is absorbed and decreased by the pressure pulsation reducing mechanism 9, blocks the propagation of the pressure pulsation to the intake piping 28 from the low-pressure fuel supply pump 21 to the pump housing 1 to prevent the intake piping 28 from being broken and, simultaneously, and allows the fuel to be supplied to the compression chamber 11 at a stable fuel pressure. Since the low-pressure chamber 10*c* is connected to the low-pressure chamber 10*d*, the both surfaces of the pressure pulsation reducing mechanism 9 are coated with fuel, so that the pressure pulsation of the fuel is effectively inhibited.

Also, the pressure pulsation reducing mechanism 9 also has the pulsation reducing effect for the fuel flowing through the route (2) to the low-pressure fuel capacity chamber.

The annular low-pressure chamber 10*f* as the fuel trap portion 67 exists between the lower end of the cylinder 6 and the plunger seal apparatus 13, and the annular low-pressure chamber 10*f* is connected to the low-pressure chamber 10*d* by the route 3 (the low-pressure chamber 10*d*—the low-pressure fuel channel 10*e*—the annular low-pressure chamber 10*h*—the groove 7 provided on the holder 7). When the plunger 2 repeats the sliding movement in the cylinder 6, a coupling portion between the large-diameter portion 2*a* and the small diameter portion 2*b* repeats upward and downward movements in the annular low-pressure chamber 10*f* and the capacity of the annular low-pressure chamber 10*f* is changed. In the intake step, the capacity of the annular low-pressure chamber 10*f* is reduced and the fuel in the annular low-pressure chamber 10*f* flows to the low-pressure chamber 10*d* through a low-pressure channel 11*e*. In the returning step and the discharging step, the capacity of the annular low-pressure chamber 10*f* is increased and the fuel in low-pressure chamber 10*d* flows to the annular low-pressure chamber 10*f* through a low-pressure channel 11*e*.

When focusing on the low-pressure chamber 10*d*, the fuel flows from the low-pressure chamber 10*d* to the compression chamber 11 while the fuel flows from the annular low-pressure chamber 10*f* into the low-pressure chamber 10*d* in the intake step. In the returning step, the fuel flows from the compression chamber 11 into the low-pressure chamber 10*d*, while the fuel is flowed from the low-pressure chamber 10*d* to the annular low-pressure chamber 10*f*. In the discharging step, the fuel flows from the annular low-pressure chamber 10*f* into the low-pressure chamber 10*d*. In this manner, the annular low-pressure chamber 10*f* has a function to aid the fuel to go in and out from the low-pressure chamber 10*d*, and hence has an effect of reducing the pressure pulsation of the fuel generated in the low-pressure chamber 10*d*.

Also, since the pressure pulsation reducing mechanism 9 is provided between the low-pressure fuel port 10*a* and the low-pressure fuel port 10*b*, the pressure pulsation generated in association with the vertical movement of the plunger 2 is absorbed by the pressure pulsation reducing mechanism 9, and hence the propagation of the pressure pulsation to the low-pressure fuel capacity chamber 43 is prevented.

Figure 3:
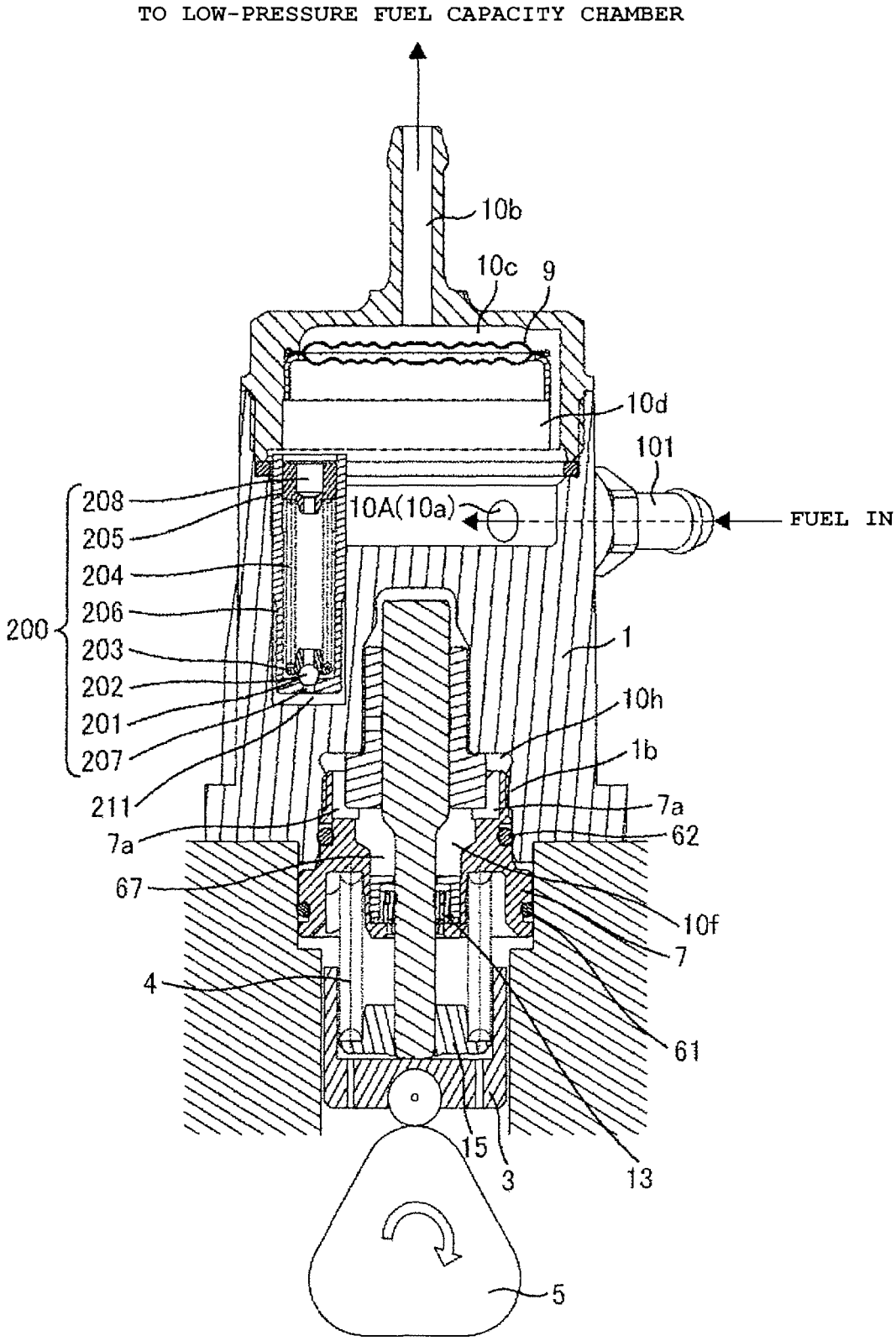
FIG. 3 is another vertical cross-sectional view of the high-pressure fuel supply pump according to the first embodiment in which the invention is implemented, taken along the line III-III in FIG. 8.

As shown in FIG. 3, a relief channel 211 is provided with a relief valve mechanism 200 configured to confine the flow of the fuel only in one direction from the discharge channel to the low-pressure chamber 10*d*, and the entry of the relief valve mechanism 200 communicates with the downstream side of the discharge valve 8*b* by a flow channel, not shown.

Hereinafter, the operation of the relief valve mechanism 200 will be described. A set valve-opening pressure is set so that a relief valve 202 is pressed against a relief valve seat 201 by a relief spring 204 configured to generate a pressing force, and when the pressure difference between the interior of the intake chamber and the interior of the relief channel is increased to a level equal to or higher than a prescribed pressure, the relief valve 202 moves away from the relief valve seat 201, and the valve is opened. Here, the pressure when the relief valve 202 starts opening is defined as a set valve-opening pressure.

The relief valve mechanism 200 includes a relief valve housing 206 integral with the relief valve seat 201, the relief valve 202, a relief valve holder 203, the relief spring 204, and a relief spring adjuster 205. The relief valve mechanism 200 is assembled on the outside of the pump housing 1 as a sub-assembly, and then is fixed to the pump housing 1 by press-fitting.

First of all, the relief valve 202, the relief valve holder 203, and the relief spring 204 is inserted into the relief valve housing 206 in this order, and the relief spring adjuster 205 is press-fitted into and fixed to the relief valve housing 206. A set load of the relief spring 204 is determined by the position where the relief spring adjuster 205 is fixed. The valve-opening pressure of the relief valve 202 is determined by the set load of the relief spring 204. The relief sub-assembly 200 obtained in this manner is press-fitted into and fixed to the pump housing 1.

In this case, the valve-opening pressure of the relief valve 200 is set to a pressure higher than the maximum pressure within the normal operating range of the high-pressure fuel supply pump.

When an abnormal high-pressure in the high-pressure fuel capacity chamber 23 generated by malfunction of high-pressure fuel injection apparatus (23, 24, 30) configured to supply fuel to the engine, or malfunction of the ECU 27 or the like which controls the high-pressure fuel supply pump or the like reaches a voltage equal to or higher than a set valve opening pressure of the relief valve 202, the fuel passes from the downstream side of the discharge valve 8*b* through the relief channel 211 and reaches the relief valve 202. Then, the fuel passed through the relief valve 202 is released into the low-pressure chamber 10*d* as a low-pressure portion of an escape channel 208 opened by the relief spring adjuster 205. Accordingly, the protection of the high-pressure portion of the high-pressure fuel capacity chamber 23 or the like is achieved.

In the manner as described above, although the fuel is supplied to the internal combustion engine by the high-pressure fuel injection apparatus (23, 24, 30) or a low-pressure fuel injection apparatus (41, 43, 44), the amount of fuel injected from the respective injection apparatuses depend on the state of operation of the internal combustion engine. For example, it is the operating state in which quietness is required such as an idling operation. When the fuel is injected from the high-pressure fuel injection valves 24, the high-pressure fuel supply pump needs to compress the fuel to a high pressure, and supplies the same to the high-pressure fuel capacity chamber. At this time, in the variable capacity control mechanism 30, since metal collides and generates a collision sound in the discharge valve 8 or the like, the required quietness is impaired. Therefore, in the state of the idling operation, if the warming-up is completed, the quietness can be maintained by injecting low-pressure fuel compressed by the low-pressure fuel supply pump 20 from the low-pressure fuel injection apparatus (41, 43, 44) to the air-intake port. The low-pressure fuel supplied to the low-pressure fuel capacity chamber 43 passes through the high-pressure fuel supply pump. In other words, the low-pressure fuel flowed from the low pressure fuel port 10*a* into the low-pressure chamber 10*d* passes through the pressure pulsation reducing mechanism 9 and the low-pressure chamber 10*c*, and then is supplied from the low-pressure fuel port 10*b* to the low-pressure fuel capacity chamber 43 via the low-pressure fuel channel 41.

When the internal combustion engine is configured in such a manner that the fuel is supplied only by the low-pressure fuel injection apparatus (41, 43, 44), the high-pressure fuel supply pump needs not to compress the fuel to a high pressure. In this case, the fuel in the compression chamber 11 repeats a reciprocal motion with respect to the low-pressure chamber 10*d* in association with the sliding movement of the plunger 2. Accordingly, the pressure pulsation occurs in the low-pressure fuel, but the pressure pulsation can be reduced by the mechanism described above. In particular, by providing the pressure pulsation reducing mechanism between the low-pressure fuel port 10*a* and the low-pressure fuel port 10*b*, the pressure pulsation of the low-pressure fuel caused by the sliding movement of the plunger 2 is prevented from propagating to the low-pressure fuel channel 41 and the low-pressure fuel capacity chamber 43. Therefore, the low-pressure fuel injection apparatus (41, 43, 44) can repeat the stable injection. For reference, in an operating state of the engine for supplying fuel only to the low-pressure fuel injection apparatus (41, 43, 44), the variable capacity control mechanism 30 of the high-pressure fuel supply pump continues to distribute a current to the coil 36 of the electromagnetic drive mechanism to maintain the state of zero discharge. In order to keep the power consumption at this time to be low, the configuration of this embodiment which can maintain the valve-opening state of the intake valve with a small magnetic force is effective.

The plunger 2 and the cylinder 6 repeat the sliding movement even when the internal combustion engine is operated only by the low-pressure fuel injection apparatus (41, 43, 44). The outer shape of the large-diameter portion 2*a* of the plunger 2 as the sliding portion and the inner diameter of the cylinder 6 are set to define a clearance (gap) on the order of, for example, 8 to 10 μm. Normally, the clearance is filled with the fuel in the form of a thin film, whereby a smooth sliding movement is secured. When the thin film of the fuel is discontinued for any reason, the plunger 2 and the cylinder 6 are locked during the sliding movement and are secured, so that a problem that the fuel cannot be compressed to a high pressure occurs. In a state in which the high-pressure fuel supply pump compresses the fuel to a high pressure and discharges the same, the pressure of the fuel in the compression chamber 11 is increased, and a significantly minute high-pressure fuel can easily be pumped to the annular low-pressure chamber 10*f* through the clearance. Therefore, the discontinuity of the thin film of the fuel can hardly occur. Also, heat generated by the sliding movement of the plunger 2 and the cylinder 6 is taken away to the outside of the high-pressure fuel supply pump by the compressed high-pressure fuel. Therefore, the thin film discontinuity caused by evaporation of the thin film of the fuel during the clearance due to the temperature rise does not occur.

In the related art in which the fuel to be supplied to the low-pressure fuel injection apparatus (41, 43, 44) does not pass through the high-pressure fuel supply pump, the probability of occurrence of the phenomenon of the thin film discontinuity of the fuel is increased when the internal combustion engine supplies the fuel only by the low-pressure fuel injection apparatus (41, 43, 44). The reason is that the high-pressure fuel supply pump does not require the compression of the fuel to a high pressure, and hence the fuel pressure of the compression chamber 11 is the same low pressure as the low-pressure chamber 10*d* and the annular low-pressure chamber 10*f*. Therefore, since the fuel does not flow to the annular low-pressure chamber 10*f* from the compression chamber 11 to the clearance, the probability of occurrence of the thin film discontinuity increases. In addition, the heat caused by the sliding movement of the plunger 2 and the cylinder 6 is not taken away to the outside, the plunger 2, the cylinder 6, and the components of the periphery thereof increase the temperature. Consequently, the thin film of the fuel in the clearance is evaporated, and hence the thin film of the fuel cannot be sufficiently secured.

According to the embodiment of the invention described above, this problem can be solved. In other words, the low-pressure fuel port 10*a* configured to intake the low-pressure fuel from the fuel tank 20 and the low-pressure fuel port 10*b* communicating with the low-pressure fuel capacity chamber 43 are provided in the high-pressure fuel supply pump, and the pressure pulsation reducing mechanism 9 is provided therebetween. On both surfaces of the pressure pulsation reducing mechanism 9, the low-pressure chamber 10*c* and the low-pressure chamber 10*d* exist. The low-pressure fuel port 10*a* is opened to the low-pressure chamber 10*d*, and the low-pressure intake port 10*b* is opened to the low-pressure chamber 10*c*. The plunger 2 is provided with the large-diameter portion 2*a* and the small diameter portion 2*b*, and the annular low-pressure chamber 10*f* is configured to be changed in capacity in association with the sliding movement of the plunger 2. In this configuration, even when the internal combustion engine supplies the fuel only by the low-pressure fuel injection apparatus (41, 43, 44), the fuel passes through the interior of the high-pressure fuel supply pump, and hence has an effect to take away the frictional heat from the high-pressure fuel supply pump. In addition, since the annular low-pressure chamber 10*f* always transfers the fuel with respect to the low-pressure chamber 10*d*, the annular low-pressure chamber 10*f* is always filled with the fresh fuel of a low temperature. Accordingly, the temperature rise of the plunger 2 and the cylinder 6 maybe inhibited, and the thin film discontinuity of the fuel due to the evaporation of the thin film of the fuel existing in the clearance is inhibited.

Also as in the embodiment, by providing two low-pressure fuel ports on the high-pressure fuel supply pump, there is an advantage that the assembly steps of the internal combustion engine can be reduced. In a structure in which the low-pressure fuel supply system and the high-pressure fuel supply system are separated on the outside of the high-pressure fuel supply pump, a specific joint or the like must be built into a bifurcated portion and bifurcated when the internal combustion engine is assembled. In contrast, in high-pressure fuel supply pump according to the invention, the low-pressure piping, the low-pressure fuel supply system, and the high-pressure fuel supply system may be assembled to the high-pressure fuel supply pump respectively.

In FIG. 5, an improved idea not shown in FIG. 1 is illustrated. The difference between FIG. 5 and FIG. 1 is that an orifice 103B exists between the low-pressure fuel port 10*b* and the low-pressure chamber 10*c* (others are all the same as the first embodiment shown in FIG. 1 to FIG. 4).

The pressure pulsation generated by the vertical movement of the plunger 2 is absorbed by the pressure pulsation reducing mechanism 9. However, by providing the orifice 103B between the low-pressure fuel port 10*b* and the low-pressure chamber 10*c*, the propagation of the pressure pulsation to the low-pressure fuel capacity chamber 43 is effectively prevented. When the cross-sectional area of the orifice 103B is too large, the pressure pulsation is propagated to the low-pressure fuel capacity chamber 43, and the fuel injected from the low-pressure fuel injection valve 44 to the air intake port cannot be stabilized. In contrast, when the cross-sectional area of the orifice 103B is too small, the pressure loss is increased at the orifice portion, and the fuel pressure of the low-pressure fuel capacity chamber 43 can hardly be maintained at a target pressure. With all these factors, the surface area of the orifice 103B must be selected in a careful way.

Also, the same effect is obtained even when a check valve configured to confine the flow of the fuel in one direction may be provided as the mechanism for reducing the propagation of the pressure pulsation of the low-pressure fuel to the low-pressure fuel capacity chamber 43 instead of the orifice. The check valve in this case is a vale configured to confine the flow of the fuel only to one direction from the low-pressure chamber 10*c* to the low-pressure fuel port 10*b*, and the fuel does not flow in the opposite direction.

Figure 4:
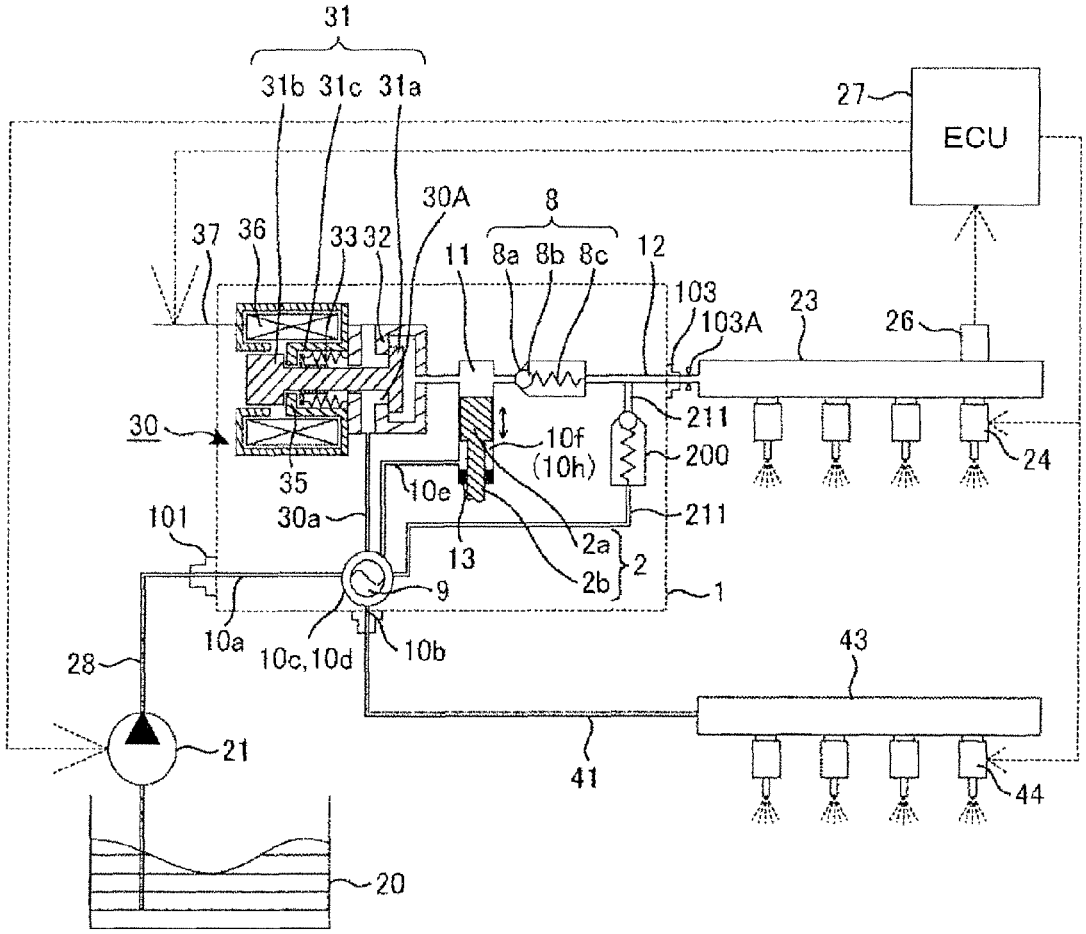
FIG. 4 is a system drawing of the high-pressure fuel supply pump according to the first embodiment in which the invention is implemented.
Figure 6:
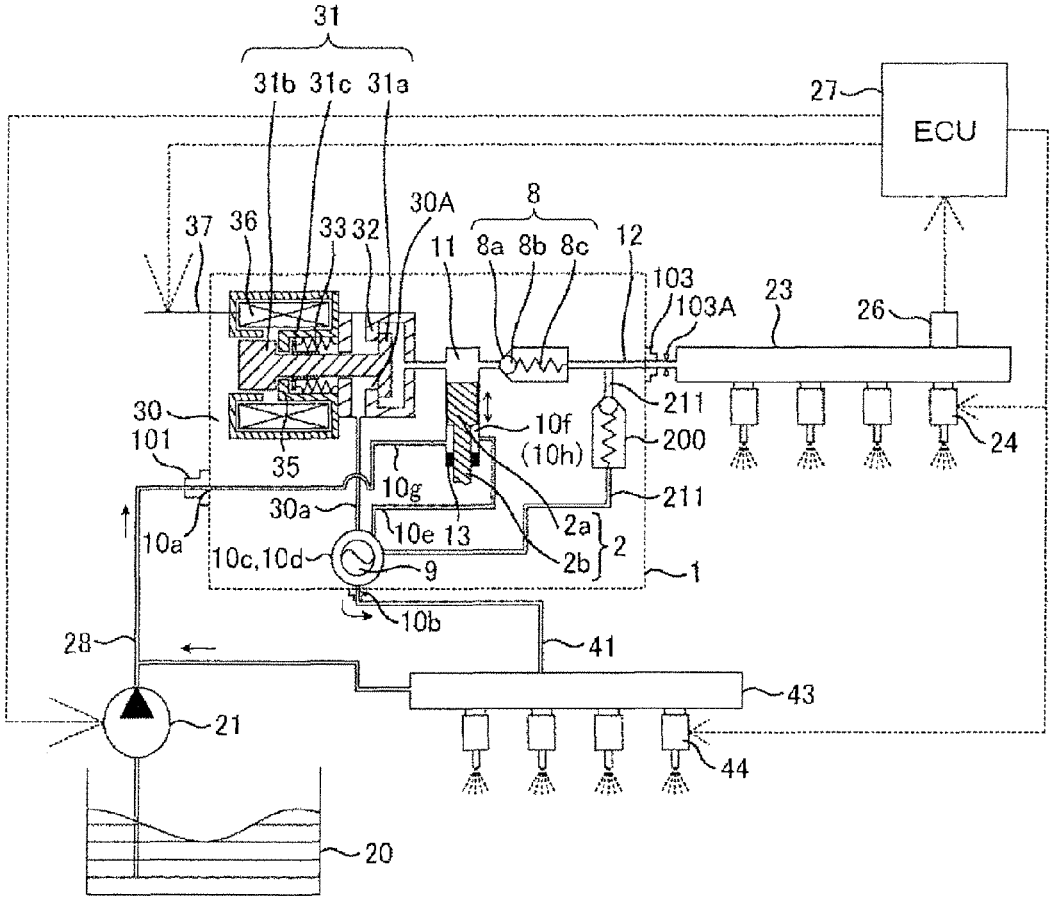
FIG. 6 is a system drawing of a high-pressure fuel supply pump according to a second embodiment in which the invention is implemented.

For reference, unlike FIG. 4, a configuration in which the low-pressure fuel port 10*b* is connected to the longitudinal center portion of the low-pressure fuel capacity chamber 43 with the fuel channel (the high-pressure piping) 41, and a longitudinal end of the low-pressure fuel capacity chamber 43 is connected to a midpoint of a low-pressure piping 28 as shown in FIG. 6 is also applicable. The configuration of the high-pressure fuel supply pump may be the same as FIG. 1 and FIG. 2. In this configuration, the same effect as the Embodiment 1 is obtained.

Embodiment 2

Figure 7:
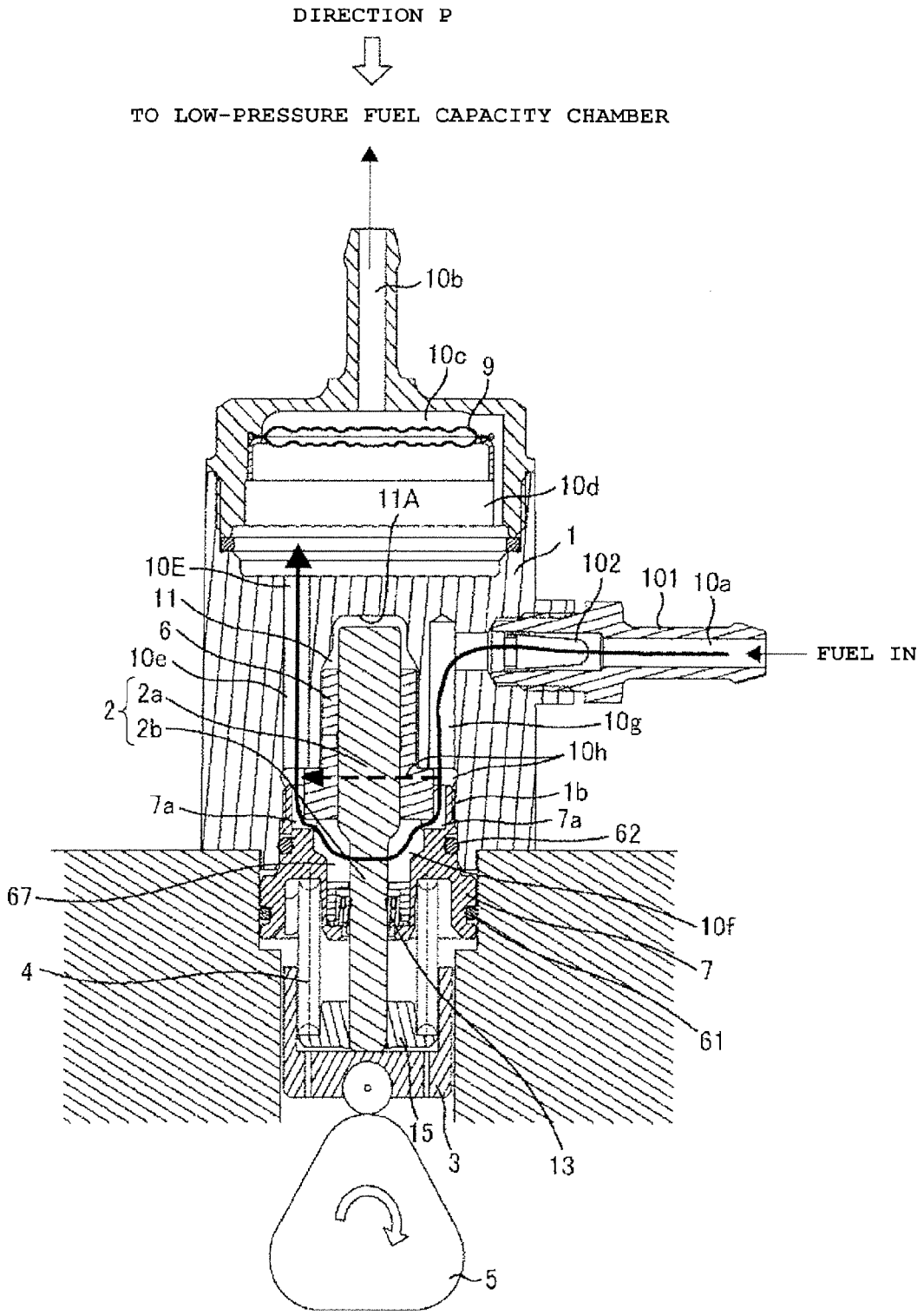
FIG. 7 is a vertical cross-sectional view of the high-pressure fuel supply pump according to the second embodiment in which the invention is implemented, taken along the line VII-VII in FIG. 8.
Figure 8:
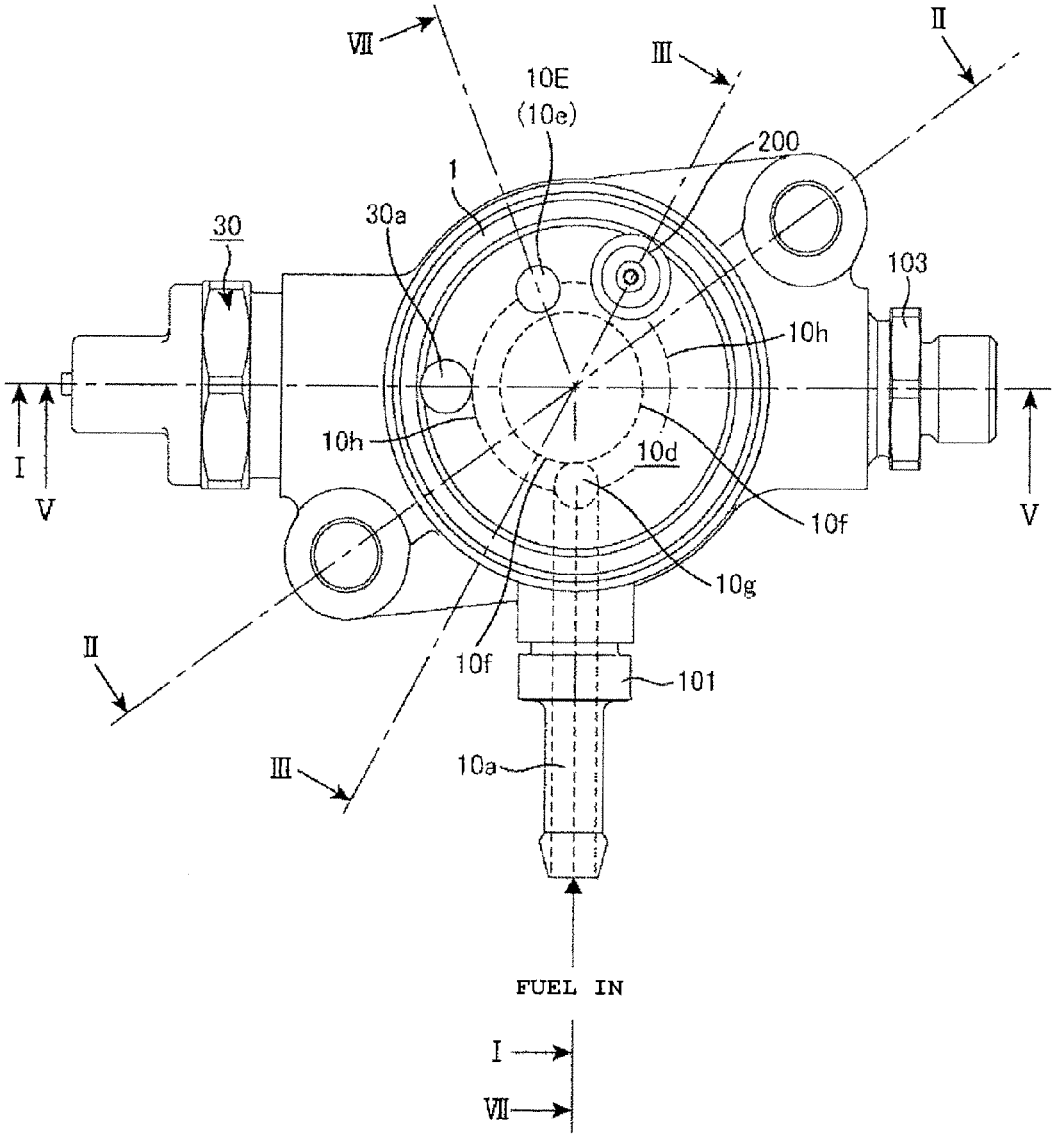
FIG. 8 is a drawing in which a damper cover and a pressure pulsation reducing mechanism of the high-pressure fuel supply pump according to the first and second embodiments in which the invention is implemented are removed viewed in the direction indicated by an arrow P in FIG. 1 (first embodiment) or FIG. 7 (second embodiment).

Another embodiment is shown in FIG. 6, FIG. 7, and FIG. 8.

FIG. 6 is a fuel supply system having a high-pressure fuel supply pump of Embodiment 2 shown in FIG. 7 and FIG. 8, and is different from the system shown in FIG. 4 in the points described above as a system.

FIG. 7 is a vertical cross-sectional view of the high-pressure fuel supply pump according to the second embodiment.

FIG. 8 is a drawing of the high-pressure fuel supply pump according to the second embodiment viewed from the direction P in FIG. 7. However, the damper cover 14 and the pressure pulsation reducing mechanism 9 or the like are not shown for the sake of convenience. For reference, there are parts which are the same as those in the first embodiment, and hence FIG. 8 is used also for the description of the first embodiment.

The different from Embodiment 1 is that the low-pressure fuel port 10*a* is connected to the annular low-pressure chamber 10*f* as the fuel trap 67 via the low-pressure fuel channel 10*g*, the annular low-pressure chamber 10*h*, and the groove 7*a* instead of the low-pressure chamber 10*d*. The point that annular low-pressure chamber 10*f* as the fuel trap portion 67 and the low-pressure chamber 10*d* are connected by the low-pressure fuel channel 10*e* is the same as Embodiment 1.

In Embodiment 2, part of fuel entered into the high-pressure fuel supply pump from the low-pressure fuel port 10*a* is taken into the annular low-pressure chamber 10*f* as the fuel trap portion 67 via the low-pressure fuel channel 10*g*, the annular low-pressure chamber 10*h*, and the groove 7*a*, and then flows into the low-pressure chamber 10*d* through the low-pressure fuel channel 10*e* as shown in FIG. 7. Part of the fuel flows from the low-pressure fuel channel log to the low-pressure fuel channel 10*e* via the annular low-pressure chamber 10*h* of the outer periphery of the cylinder 6 without passing through the annular low-pressure chamber 10*f* as the fuel trap portion 67. In this configuration, irrespective of whether the fuel is supplied to the high-pressure fuel injection apparatus (23, 24, 30) or to the low-pressure fuel injection apparatus (41, 43, 44), the fuel always passes through the annular low-pressure chamber 10*f* as the fuel trap portion 67, and hence the annular low-pressure chamber 10*f* as the fuel trap portion 67 is filled reliably with the fresh fuel always at a low temperature in comparison with Embodiment 1.

Accordingly, since the temperature rise of the plunger 2 and the cylinder 6 may be inhibited, there is an effect of inhibiting the lack of the thin film discontinuity of the fuel due to the evaporation of the thin film of the fuel existing in the clearance. Also, the fuel flowing to the low-pressure fuel channel 10*e* via the annular low-pressure chamber 10*h* on the outer periphery of the cylinder 6 takes the heat generated in the sliding portion away to the low-pressure chamber 10*d*, the cooling effect for the cylinder is enhanced.

Also, in the same manner as Embodiment 1, since the pressure pulsation reducing mechanism 9 is provided between the low-pressure fuel port 10*a* and the low-pressure fuel port 10*b*, the pressure pulsation generated in association with the vertical movement of the plunger 2 is absorbed by the pressure pulsation reducing mechanism 9, and hence the propagation of the pressure pulsation to the low-pressure fuel capacity chamber 43 is prevented.

Embodiment 3

Figure 9:
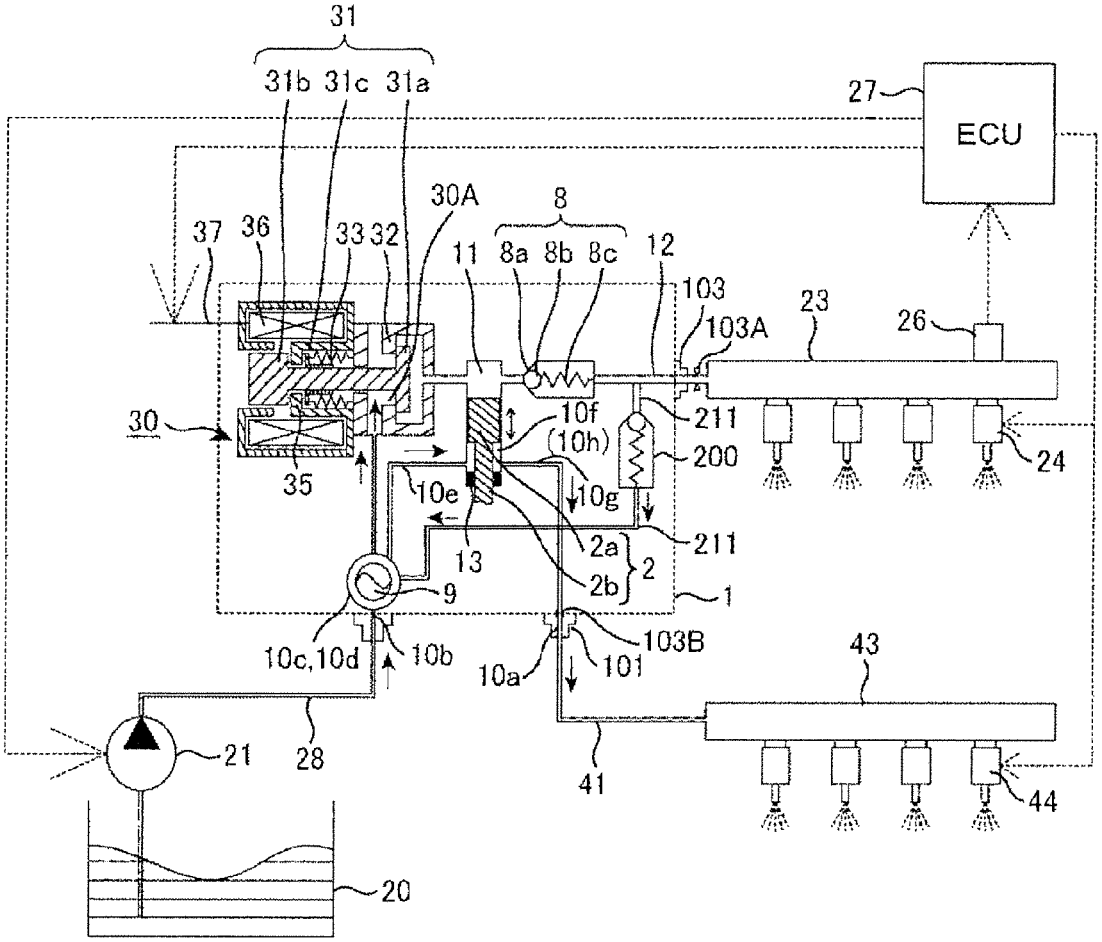
FIG. 9 is another system drawing of a high-pressure fuel supply pump according to a third embodiment in which the invention is implemented.
Figure 10:
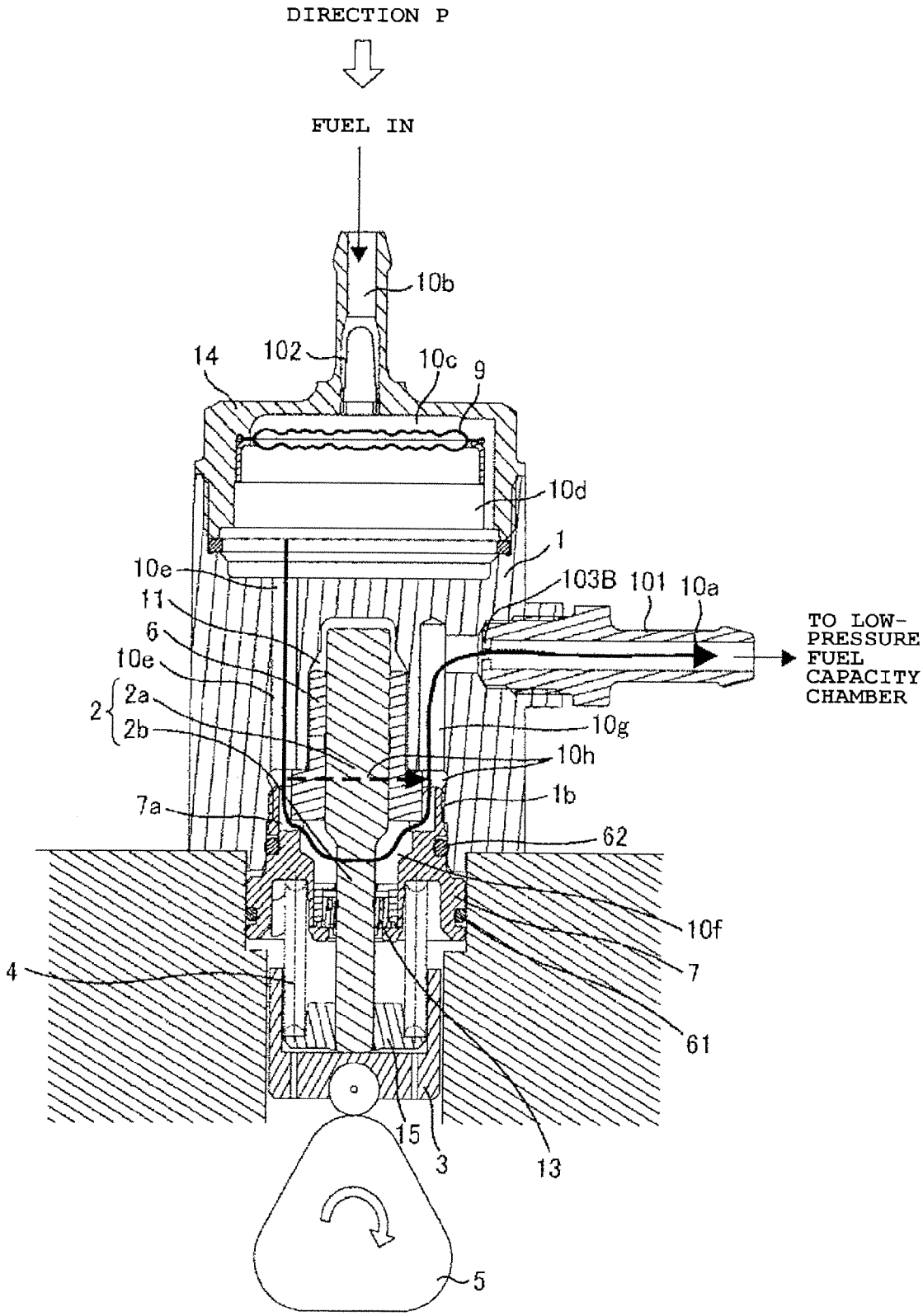
FIG. 10 is a vertical cross-sectional view of a high-pressure fuel supply pump according to the third embodiment in which the invention is implemented, taken along X-X in FIG. 11.
Figure 11:
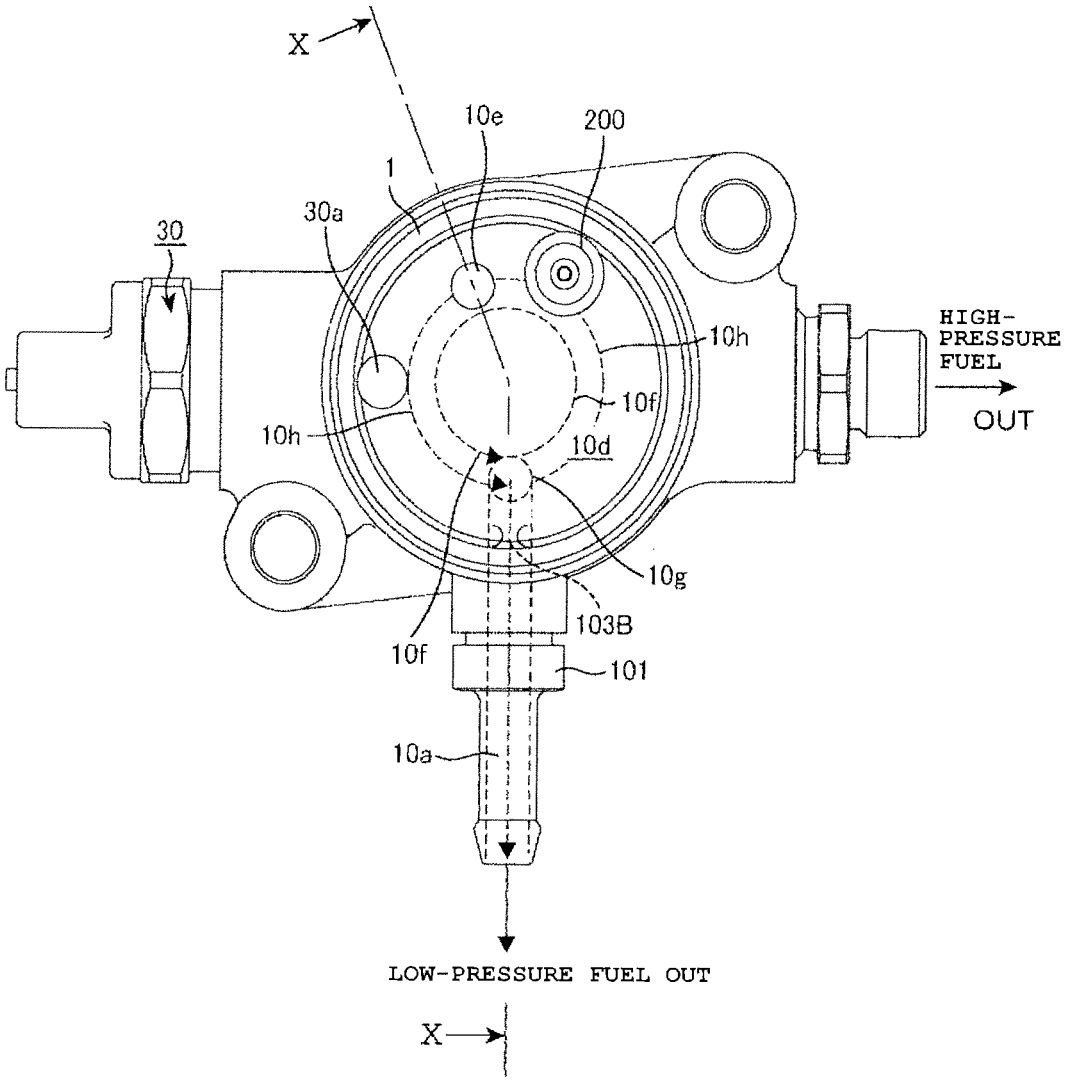
FIG. 11 is a drawing in which a damper cover 14 and a pressure pulsation reducing mechanism 9 of the high-pressure fuel supply pump according to the third embodiment in which the invention is implemented are removed viewed in the direction indicated by an arrow P in FIG. 10.

Another embodiment is shown in FIG. 9, FIG. 10, and FIG. 11.

FIG. 9 shows a fuel supply system provided with a high-pressure fuel supply pump in Embodiment 3 shown in FIG. 10 and FIG. 11. The difference from FIG. 4 and FIG. 6 as a system is that the fuel from the low-pressure fuel supply pump 21 is introduced from the low-pressure fuel port 10*b* provided in the damper cover 14 to the high-pressure fuel supply pump and is fed from the low-pressure fuel port 10*a* of the joint 101 to the low-pressure fuel capacity chamber 43.

FIG. 10 is a vertical cross-sectional view of the high-pressure fuel supply pump according to Embodiment 3.

FIG. 11 is a drawing of the high-pressure fuel supply pump according to Embodiment 3 viewed from the direction P in FIG. 10.

However, the state in which the damper cover 14 and the pressure pulsation reducing mechanism 9 are removed is shown.

The difference from the high-pressure fuel supply pump in Embodiments 1 and 2 is that the low-pressure fuel taken from the low-pressure fuel port 10*b* is connected from the low-pressure fuel port 10*a* to the low-pressure fuel capacity chamber 43 through the low-pressure chamber 10*d*, the low-pressure fuel channel 10*e*, the groove 7*a*, the annular low-pressure chamber 10*f*, the groove 7*a* and the low-pressure fuel channel 10*g*.

Part of fuel entered into the high-pressure fuel supply pump from the low-pressure fuel port 10*b* is taken into the annular low-pressure chamber 10*f* via the low-pressure chamber 10*d*, the low-pressure fuel channel 10*e* and the groove 7*a*, and then flows out to the low-pressure fuel port 10*b* via the groove 7*a*, and the low-pressure fuel channel log as shown in FIG. 10. The remaining fuel flows from the low-pressure fuel channel 10*e* to the low-pressure fuel channel log via the annular low-pressure chamber 10*h* of the outer periphery of the cylinder 6 without passing through the annular low-pressure chamber 10*f*. In this configuration, irrespective of whether the fuel is supplied to the high-pressure fuel injection apparatus (23, 24, 30) or to the low-pressure fuel injection apparatus (41, 43, 44), the fuel passes through the annular low-pressure chamber 10*f*, and hence the low pressure chamber 10*d* is filled always with the low temperature fresh fuel. Accordingly, since the temperature rise of the plunger 2 and the cylinder 6 may be inhibited, there is an effect of inhibiting the lack of the thin film of the fuel due to the evaporation of the thin film of the fuel existing in the clearance.

In this Embodiment, the orifice 103B is provided at the entrance of the joint 103. The effect of the orifice 103B is substantially the same as the orifice 3B in FIG. 5.

The modes for carrying out Embodiments described above are as follows when sorted out.

Mode 1

In a variable flow rate high-pressure fuel pump including an intake flow channel configured to take fuel into a compression chamber and a discharge flow channel configured to discharge the fuel from the compression chamber, configured to perform intake and discharge of the fuel by a plunger reciprocating in the compression chamber, the intake flow channel having an electromagnetic intake valve and the discharge flow channel having a discharge valve, respectively, and configured to control the amount of discharged fuel by switching communication and non-communication between the intake flow channel and the compression chamber by opening and closing the electromagnetic intake valve, the high-pressure furl supply pump includes two low-pressure fuel ports, and one of the two low-pressure fuel ports is connected to a low-pressure fuel supply pump, and the other one of those is connected to a low-pressure fuel injection valve configured to inject fuel to an air intake port of an internal combustion engine.

Mode 2

In the high-pressure fuel supply pump according to Embodiment 1, a pressure pulsation reducing mechanism configured to reduce pressure pulsation of low-pressure fuel is provided between the two low-pressure fuel ports.

Mode 3

The high-pressure fuel supply pump according to Embodiment 1, wherein at least one of the two low-pressure fuel ports includes means for reducing pressure pulsation of low-pressure fuel.

Mode 4

The high-pressure fuel supply pump according to Embodiment 3, wherein means for reducing the pressure pulsation of low-pressure fuel is an orifice.

Mode 5

The high-pressure fuel supply pump according to Embodiment 3, wherein means for reducing the pressure pulsation of low-pressure fuel is a vale configured to confine the flow of the fuel in one direction.

Mode 6

The high-pressure fuel supply pump according to Embodiment 3, wherein the plunger includes a large-diameter portion and a small-diameter potion, the large-diameter portion slides with respect to the cylinder, the small-diameter portion slides with respect to a plunger seal configured to prevent the fuel from flowing out, and a low-pressure chamber between a lower end portion of the cylinder and the plunger seal communicates with the two joints.

Although the description described above has been given about Embodiments, the invention is not limited thereto, and it is apparent for those skilled in the art that various modifications or corrections maybe made within the spirit of the invention and the scope of appended Claims.

REFERENCE NUMERALS

1 pump housing
2 plunger
2*a* large-diameter portion
2*b* small-diameter portion
3 tappet
5 cam
6 cylinder
7 holder
8 discharge valve unit
9 pressure pulsation reducing mechanism
10*a*, 10*b* low-pressure fuel port
10*c*, 10*d* low-pressure chamber
10*e*, 10*g* low-pressure fuel channel
10*f* annular low-pressure chamber
11 compression chamber
12 discharge port
13 plunger seal apparatus
20 fuel tank
21 low-pressure fuel supply pump
23 high-pressure fuel capacity chamber
24 high-pressure fuel injection valve
26 sensor
27 engine control unit (ECU)
30 variable capacity control mechanism
43 low-pressure fuel capacity chamber
44 low-pressure fuel injection valve

The invention claimed is:

1. A high-pressure fuel supply pump used in an internal combustion engine having high-pressure fuel injection apparatus (23, 24, 30) and low-pressure fuel injection apparatus (41, 43, 44), the apparatuses being supplied with fuel from a low-pressure fuel supply pump, wherein low-pressure fuel flows to a low-pressure fuel channel of the low-pressure fuel injection apparatus via a low-pressure fuel channel provided in a body of the high-pressure fuel supply pump even while the high-pressure fuel supply pump is making a pause.

2. The high-pressure fuel supply pump according to claim 1, wherein the fuel from the low-pressure fuel supply pump is introduced to a low-pressure fuel capacity chamber of the low-pressure fuel injection apparatus via a damper chamber of the high-pressure fuel supply pump.

3. The high-pressure fuel supply pump according to claim 1, wherein the fuel from the low-pressure fuel supply pump is introduced to a low-pressure fuel capacity chamber via a plunger seal chamber of the high-pressure fuel supply pump.

4. The high-pressure fuel supply pump according to claim 1, wherein the fuel from the low-pressure fuel supply pump is introduced to a low-pressure fuel capacity chamber by flowing through a damper chamber and a plunger seal chamber of the high-pressure fuel supply pump in this order.

5. The high-pressure fuel supply pump according to claim 1, wherein the fuel from the low-pressure fuel supply pump is introduced to a low-pressure capacity chamber via a plunger seal chamber and a damper chamber of the high-pressure fuel supply pump in this order.

6. The high-pressure fuel supply pump according to claim 1, wherein the high-pressure fuel supply pump includes two low-pressure fuel ports in addition to a high-pressure fuel discharge port configured to discharge high-pressure fuel to a high-pressure fuel capacity chamber, one of the two low-pressure fuel ports is connected to a low-pressure fuel piping continued to a low-pressure fuel capacity chamber and remaining one communicates with the low-pressure fuel piping connected to the low-pressure fuel supply pump.

7. The high-pressure fuel supply pump according to claim 1, wherein one of the low-pressure fuel ports is fixed to the damper cover, and the corresponding one of low-pressure fuel ports communicates with the damper chamber.

8. The high-pressure fuel supply pump according to claim 1, wherein one of the low-pressure fuel ports is fixed to a pump body and the corresponding one of the low-pressure fuel ports is connected to the plunger seal chamber of the high-pressure fuel supply pump.

9. The high-pressure fuel supply pump according to claim 6, wherein the low-pressure fuel port connected to the low-pressure fuel supply pump is fixed to a pump body, and the low-pressure fuel port is connected to a plunger seal chamber of the high-pressure fuel supply pump, and the other low-pressure fuel port connected to the low-pressure fuel capacity chamber is fixed to a damper cover of the high-pressure fuel supply pump, and the other low-pressure fuel port communicates with a damper chamber.

10. The high-pressure fuel supply pump according to claim 6, wherein the low-pressure fuel port connected to the low-pressure fuel supply pump is fixed to the damper cover of the high-pressure fuel supply pump, and the other low-pressure fuel port communicating with the damper chamber and connected to the low-pressure fuel capacity chamber is connected to a plunger seal chamber of the high-pressure fuel supply pump.

11. The high-pressure fuel supply pump according to claim 6, wherein the low-pressure fuel flows into a damper chamber of the high-pressure fuel supply pump from the low-pressure fuel port fixed to a damper cover of the high-pressure fuel supply pump, and flows from the damper chamber to an intake channel and a plunger seal chamber of the high-pressure fuel supply pump, and is introduced to the low-pressure fuel capacity chamber from another low-pressure fuel port fixed to a pump body of the high-pressure fuel supply pump via the plunge seal chamber.

12. The high-pressure fuel supply pump according to claim 6, wherein the low-pressure fuel flows into a plunger seal chamber of the high-pressure fuel supply pump from the low-pressure fuel port fixed to a pump body of the high-pressure fuel supply pump, and flows from the plunger seal chamber to a damper chamber and an intake channel of the high-pressure fuel supply pump, and is introduced to the low-pressure fuel capacity chamber from another low-pressure fuel port fixed to a dump cover of the high-pressure fuel supply pump.

13. The high-pressure fuel supply pump according to claim 6, wherein the low-pressure fuel flows into an intake port and a damper chamber of the high-pressure fuel supply pump from the low-pressure fuel port fixed to a pump body of the high-pressure fuel supply pump, and introduced from another low-pressure fuel port fixed to a damper cover of the high-pressure fuel supply pump to the low-pressure fuel capacity chamber and the plunger seal chamber and an intake port communicate with each other.

14. The high-pressure fuel supply pump according to claim 6, wherein the low-pressure fuel flows into an intake port and a damper chamber of the high-pressure fuel supply pump from the low-pressure fuel port fixed to a pump body of the high-pressure fuel supply pump, and introduced from another low-pressure fuel port fixed to a damper cover of the high-pressure fuel supply pump to the low-pressure fuel capacity chamber, the plunger seal chamber and an intake port communicate with each other, and the low-pressure fuel capacity chamber and an exit piping of the low-pressure fuel supply pump are connected to each other.

* * * * *